United States Patent [19]

Deguchi

[11] Patent Number: 4,882,606

[45] Date of Patent: Nov. 21, 1989

[54] DEVICE FOR GUIDING PAPER TOWARD TRANSFER REGION

[75] Inventor: Hiroyuki Deguchi, Osaka, Japan

[73] Assignee: Mita Industrial Co., Ltd., Osaka, Japan

[21] Appl. No.: 221,419

[22] Filed: Jul. 19, 1988

[30] Foreign Application Priority Data

Jul. 21, 1987 [JP] Japan ..... 62-184306

[51] Int. Cl.[4] ..... G03G 15/14; G03G 15/16

[52] U.S. Cl. ..... 355/274; 355/309

[58] Field of Search ..... 271/307, 310; 355/3 TR, 355/3 SH, 3 R, 14 SH, 271, 309, 315, 274

[56] References Cited

U.S. PATENT DOCUMENTS 4,009,957 3/1977 Suzuki et al. ..... 355/309 X
4,544,262 10/1985 Kanemitsu et al. ..... 355/315

FOREIGN PATENT DOCUMENTS 0031983 2/1984 Japan ..... 355/3 TE
0043671 3/1985 Japan ..... 355/3 SH
0066277 4/1985 Japan ..... 355/315

*Primary Examiner*—A. T. Grimley
*Assistant Examiner*—Barry J. Shapiro
*Attorney, Agent, or Firm*—Wenderoth, Lind & Ponack

[57] ABSTRACT

The present invention relates to a device for guiding a paper toward a transfer region disposed in the vicinity of a sensitive member. A lower guide comprises at least two elastic members, the at least two elastic members being adapted to change elastic modulus depending upon a rigidity of the paper being conveyed toward the sensitive member, whereby the paper can be guided toward the sensitive member under the best condition, regardless of the quality of the paper.

9 Claims, 6 Drawing Sheets

DEVICE FOR GUIDING PAPER TOWARD TRANSFER REGION

BACKGROUND OF THE INVENTION

1. Field of the Invention

The present invention relates to a device for guiding a paper toward a transfer region, comprising an upper guide and a lower guide disposed in the upper reaches of a transfer region in a paper-transferring direction.

2. Description of the Prior Art

In general, in an electrostatic photographic copying machine, printer or the like, a device for guiding a paper toward a transfer region comprises an upper guide and a lower guide disposed in the vicinity of a sensitive member, in the upper reaches of the transfer region in a paper-transferring direction, to guide the paper to be transferred toward the transfer region. For example, as disclosed in Japanese Utility Model Laid-Open No. 69848/1983, both guides are formed of a rigid plate material, and at least one of them is movable by the reaction of a spring (prior art 1 ) or, as disclosed in Japanese Utility model Laid-Open No. 138956/1983, a lower guide is formed of a piece of flexible material (prior art 2 ).

However, the above described prior art 1 has a disadvantage in that the spring pressure is remarkably difficult to be set so as to match paper qualities over a wide range, from hard quality (thick paper) to a soft quality (thin paper), that is a set pressure is insufficient to match all kinds of paper. In addition, the above described prior art 2 has a disadvantage in that it is difficult to select a particular hardness of the flexible member, and thus a single flexible member can not match all kinds of paper. Furthermore, a measure for eliminating the disadvantage of the prior art 2 , in which a special shape is given to the flexible member, for example the flexible member being provided with an uneven portion in a pointer end thereof, has been considered but this measure shows a disadvantage in that the pointed end if easily worn by the paper, that is, it is inferior in durability.

SUMMARY OF THE INVENTION

The present invention was achieved in view of the above described disadvantage of the prior art.

Thus, it is an object of the present invention to provide a device for guiding a paper toward a transfer region capable of guiding a paper relative to a sensitive member always under the best condition regardless of a quality of the paper.

In order to achieve the above described object, a device for guiding a paper toward a transfer region according to the present invention is provided with a lower guide comprising at least two elastic members so that the elastic modulus of the lower guide will vary depending upon the rigidity of the paper transferred toward a sensitive member.

With the device for guiding a paper toward a transfer region having the above described characteristic construction, the lower guide is adapted to show a smaller elastic modulus or spring constant for a soft paper and show a larger elastic modulus for a hard paper, whereby the paper can be guided relative to the sensitive member always under the best condition.

BRIEF DESCRIPTION OF THE DRAWINGS

One preferred embodiment of the present invention is shown in FIGS. 1 to 5, in which.

DESCRIPTION OF THE PREFERRED EMBODIMENTS

Figure 1:
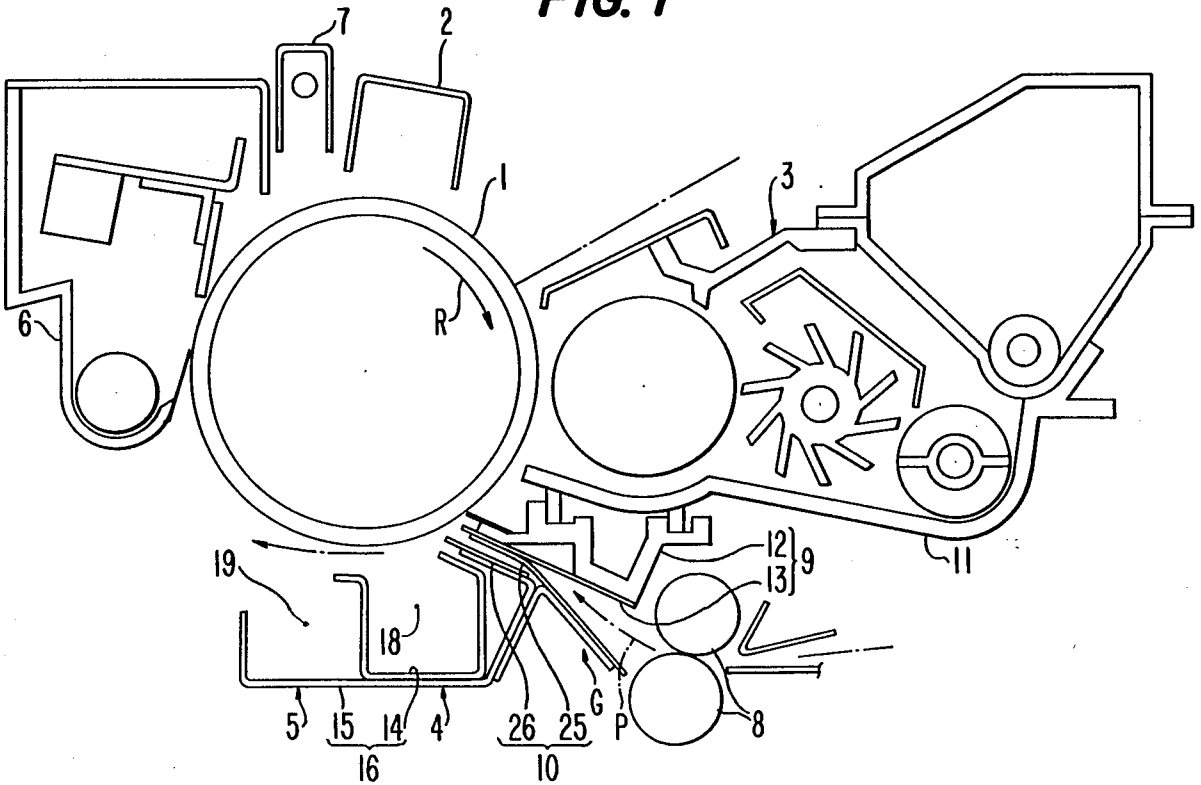
FIG. 1 is a sectional view showing principal parts of an electrostatic photographic copying machine with a device for guiding a paper toward a transfer region according to the present invention incorporated therein.

Referring now to FIG. 1, reference numeral 1 designates a sensitive member rotating in a direction shown by an arrow R and surrounded by an electrifying device 2, a developing device 3, a transfer charger 4, a separating charger 5, a cleaning device 6, and a deelectrifying device 7.

Reference numeral 8 designates a pair of conveyor rollers disposed at a position close to the sensitive member 1 and the upper reaches of a transfer region in a paper P-transferring direction (hereinafter referred to as an upstream side) and connected with a paper-feeding device (not shown) at the upstream side thereof. Reference mark G designates a device for guiding a paper toward a transfer region disposed between the pair of conveyor rollers 8 and the sensitive member 1 and comprising an upper guide 9 and a lower guide 10.

The upper guide 9 comprises a plate member 13 fixedly mounted on an underside of a guide base 12 projected below for example a housing 11 of the developing device 3 so that an entering direction of the paper P relative to the sensitive member 1 may be controlled.

Figure 2:
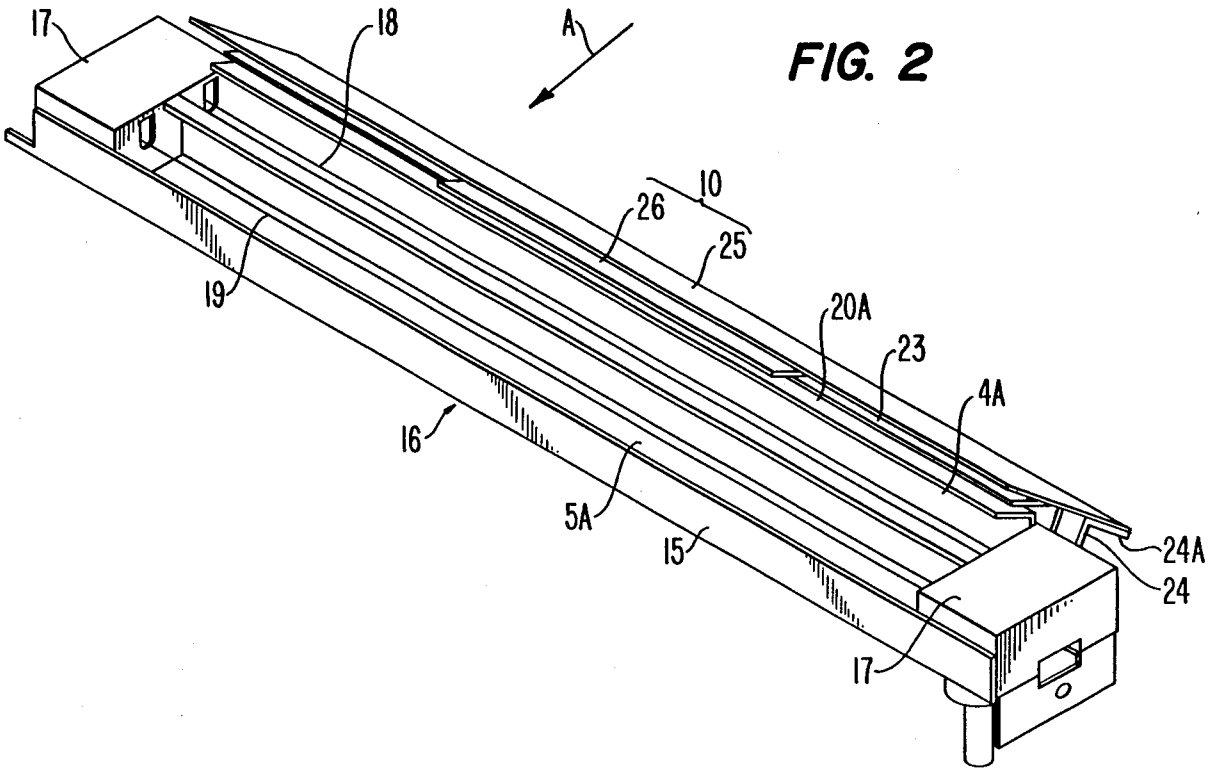
FIGS. 2 and 3 are a perspective view and a sectional view, respectively, showing an installed condition of a lower guide according to the present invention.
Figure 3:
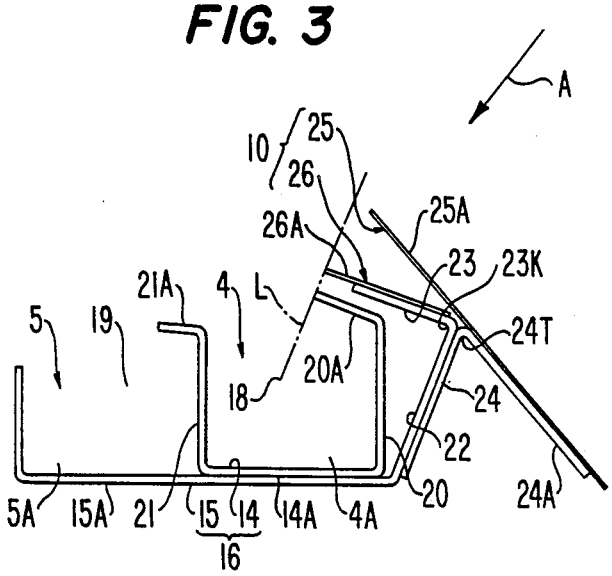

On the other hand, the lower guide 10 has a construction as shown in FIGS. 2, 3 but the construction of the transfer charger 4 and the separating charger 5 is described with reference to FIGS. 2, 3 prior to the description of the lower guide 10. The transfer charger 4 and the separating charger 5 are disposed within an integrated shield case 16, in which an inside of a bottom plate 15A of an outside shield case 15 is joined with an outside of a bottom plate 14A of an inside shield case 14 in an overlapped manner, adjacent to each other, the shield case 16 provided with a pair of end blocks 17, 17 on both ends thereof.

Wires 18, 19 used as discharge electrodes are extended between the end blocks 17, 17 within an internal space 4A of the inside shield case 14 and a space 5A between the inside shield case 14 and the outside shield case 15, respectively.

In the inside shield case 14 an upper end portion of a side plate member 20 on the upstream side of the inside shield case 14 is bent toward a downstream side to form a transfer electrifying region-controlling member 20A. The transfer electrifying region-controlling member 20A is formed in the inside shield case 14 in such a manner that a transfer voltage can be prevented from being applied on the paper in a region where the paper P conveyed toward the sensitive member 1 is not brought into close contact with a surface of the sensitive member 1, to carry out copying of 2 high image quality. In addition, an upper end portion of a side plate member 21 on the downstream side of the inside shield case 14 is bent toward a downstream side to form a separating electrification-controlling member 21A so that the paper P may be surely separated from the surface of the sensitive member 1 after the completion of the transfer.

On the other hand, in the outside shield case 15 a side plate member 22 of the outside shield case 15, on an upstream side thereof, extends from the bottom plate 155A in an oblique direction, and an upper end portion of this side plate member 22 is bent toward a downstream side at an angle of about 90° relative to the side plate member 22 to form a turning member 23. In addition, the side plate member 22 is provided with a member 24 having an almost mountain-shaped section mounted on a surface thereof on an upstream side in the paper-conveying direction so as to have a length almost the same as that of the side plate member 22 along the side plate member 22, under the condition that a summit 24T of the member 24 nearly coincides with a turning base 23K of the turning member 23. And, the almost mountain-shaped member 24 is provided with an upstream side leg member 24A formed at the upper extent of the summit 24T thereof.

Reference numerals 25, 26 designate a first and second member, the lower guide 10 comprising both the members 25, 26. That is to say, the first member 25 is fixedly mounted on an upper surface side of the upstream side leg member 24A of the mountain-shaped member 24 so that a free end portion 25A thereof may be positioned above the turning member 23 over the entire width of the mountain-shaped member 24. In addition, the second member 26 is fixedly mounted on a central portion of an upper surface side of the turning member 23 with a predetermined length (a length equal to for example a size of a longer side of a postal card) so that a free end portion 26A thereof may be positioned above the transfer electrifying region-controlling member 20A. In short, the first member 25 and the second member 26 are disposed so that at least a part thereof on a free end side may be overlapped as seen from a direction nearly perpendicular to the surface of the paper P being conveyed (a direction shown by an arrow A in FIGS. 2, 3 in this preferred embodiment).

The first member 25 is adapted to not project a pointed end of the free end portion 25A to a downstream side of a pointed end of the free end portion 26A of the second member 26 when the free end portion 25A of the first member 25 is bent downward (toward a side of the second member 26). In addition, the second member 26 is adapted to not project the pointed end of the free end portion 26A thereof to a downstream side of a line L connecting the wire 18 with a pointed end of the transfer electrifying region-controlling member 20A on a downstream side thereof or an extension of this line L (see FIG. 3). The reason why the pointed ends of the free end portions 25A, 26A of the first member 25 and second member 26 are adapted to not project to the downstream side of the line L connecting the wire 18 with the pointed end of the transfer electrifying region-controlling member 20A on a downstream side thereof or the extension of the line L even though they are moved by bending and the like is that the controlling action of the transfer electrifying region-controlling member 20A formed by bending the upper end portion of the side plate member 20 on an upstream side of the inside shield case 14 should not be interfered with.

In the present preferred embodiment, the first member 25 is formed of a polyester film having a thickness of about 100 microns and the second member 26 is formed of a polyester film having a thickness of about 200 microns. And, the first member 25 is adapted to be easily bendable in comparison with the second member 26.

Figure 5:
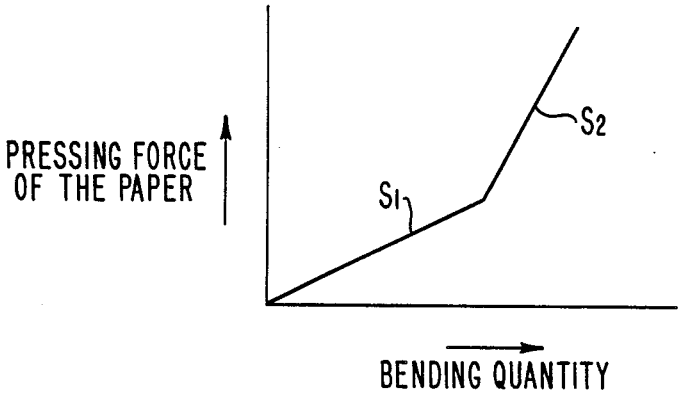
FIG. 5 is a diagram showing characteristics of the lower guide.
Figure 4A:
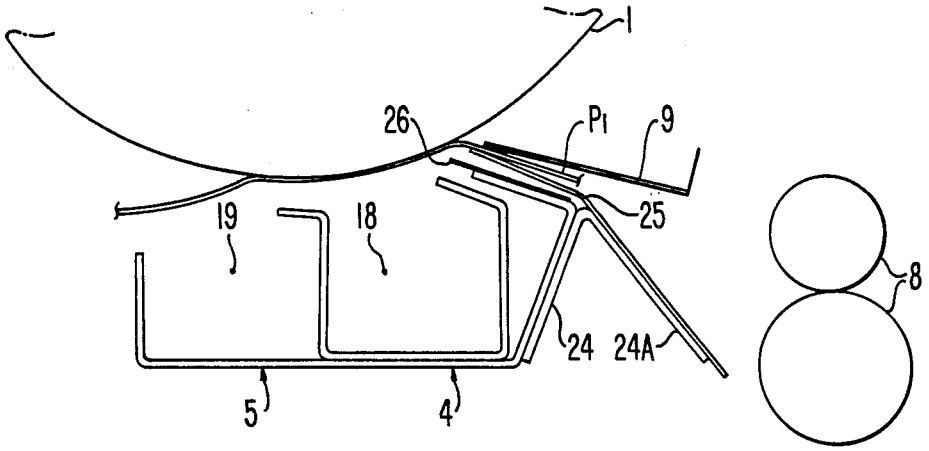
FIGS. 4(A), 4(B) are diagrams illustrating the operation of the present invention.

Next, an operation of the device G for guiding a paper toward a transfer region having the above described construction will be below described with reference to FIGS. 4(A), 4(B) and 5.

At first, when a thin paper $P_1$ (for example a usual copying paper of about 50 to 80 g/m$^2$) enters the device G for guiding a paper toward a transfer region through the pair of conveyor rollers 8 as shown in FIG. 4 (A), this paper $P_1$ is led to the sensitive member 1 along the first member 25 and under the guidance of the upper guide 9 in a stable manner. At this time only the first member 25 is brought into contact with the paper $P_1$ and only the first member 25 is bent by a pressing force of the paper $P_1$. The bending characteristics of the lower guide 10 at this time are shown by a straight line $S_1$ in FIG. 5. In FIG. 5, the abscissa indicates a bending ordinate indicates a pressing force of the paper against the lower guide 10.

Figure 4B:
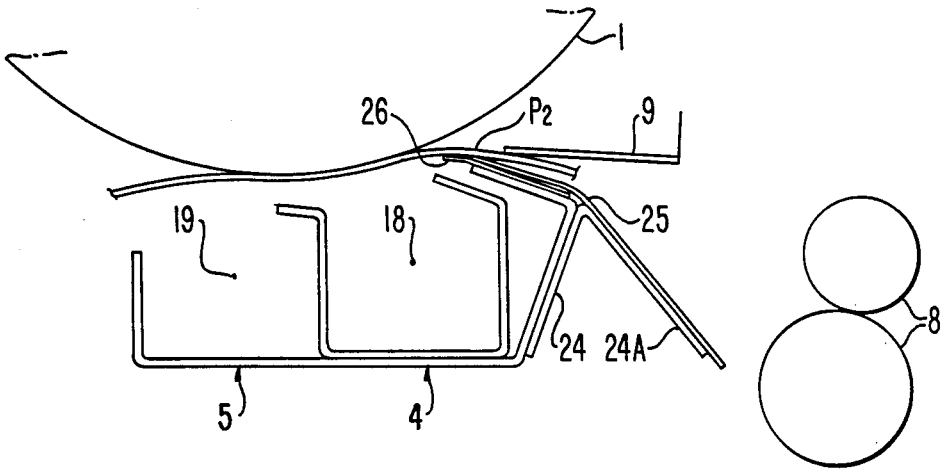

Subsequently, when a thick paper $P_2$ (for example a postal card of about 150 g/m$^2$) enters the device G for guiding a paper toward a transfer region through the pair of conveyor rollers 8, the first member 25 is bent downward by the pressing force of the paper $P_2$, whereby the first member 25 is overlapped on to the second member 26, as shown in FIG. 4(B). As a result, the paper $P_2$ is guided toward the sensitive member 1 in a direction controlled by the first member 25 and the second member 26 in a stablemanner posture. At this time, not only the first member 25 but also the second member 26 are slightly bent downward, so that the lower guide 10 shows the bending characteristics shown by a straight line $S_2$ in FIG. 5. In short, this straight line $S_2$ corresponds to a rough synthesis of an elastic modulus of the first member 25 and that of the second member 26 different from the straight line $S_1$, and having a slope different from that of the straight line $S_1$.

In addition, in the case (not shown) where a paper having local folds, such as label paper, is used as the paper, shocks due to folds during the conveyance are absorbed by the first member 25 to convey the paper toward the sensitive member 1 in a stable manner.

In addition, although the first member 25 is adapted to be easily bendable in comparison with the second member 26, the second member 26 may be equalized to the first member 25 in bendability (for example a thickness of 150 microns is given to both the first member 25 and the second member 26) or the second member 26 may be adapted to be easily bendable in comparison with the first member 25 because, in both cases, a synthetic elastic modulus of both members 25, 26 becomes larger than that of the first member 25 alone.

The members, of which the lower guide 10 is composed, may be formed of synthetic resin materials, such as vinyl chloride film and sponges in addition to the above described polyester film. Furthermore, they may be formed of metallic materials, such as phosphor bronze, having good elastic properties. But, in this case, it is necessary to subject them to insulative painting, because the use of the metallic materials as they are leads to an escape of an electric charge along a rear surface of the paper P, thereby lowering the transfer efficiency.

Figure 6:
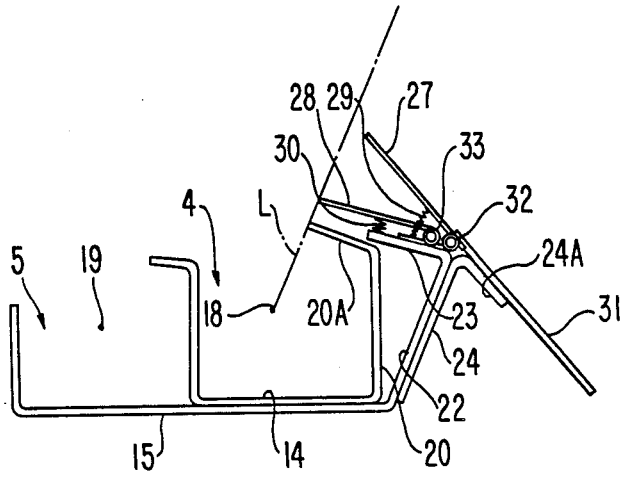

FIGS. 6 to 10 show constructions of lower guides according to further preferred embodiments. Referring to FIG. 6, rigid guide plates 27, 28 are adapted to be energized by compression springs 29, 30 having different spring constants, reference numeral 31 designating a member supported by a leg member 24A on an upstream side of mountain-shaped member 24, reference numerals 32 designating a hinge member disposed at an upper end of member 31 for holding a lower end side of the guide plate 27, and reference numeral 33 designating a hinge member for holding a lower end side of the guide plate 28.

Figure 7:
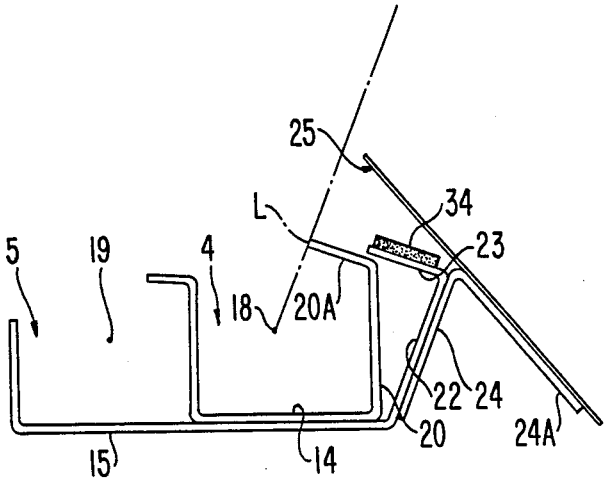

FIG. 7 shows a case where the second member 26, formed of a polyester film in FIG. 3, is replaced by a sponge member 34.

Figure 8:
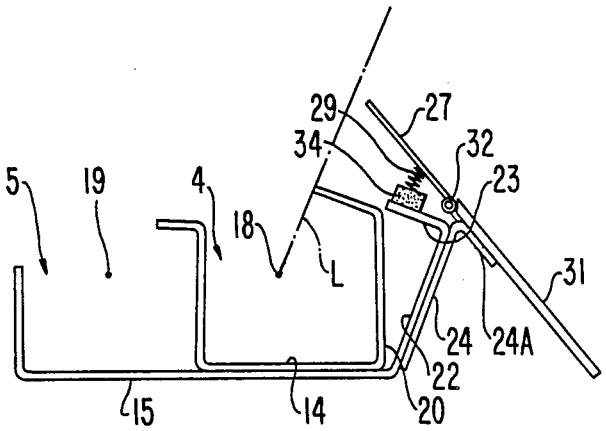

In addition, FIG. 8 shows a combination of the guide plate 27 and the sponge member 34, a compression spring 29 for energizing the guide plate 27 being disposed between the guide plate 27 and the sponge member 34. The compression spring 29 is adapted to be easily bendable in comparison with the sponge member 34.

Figure 9:
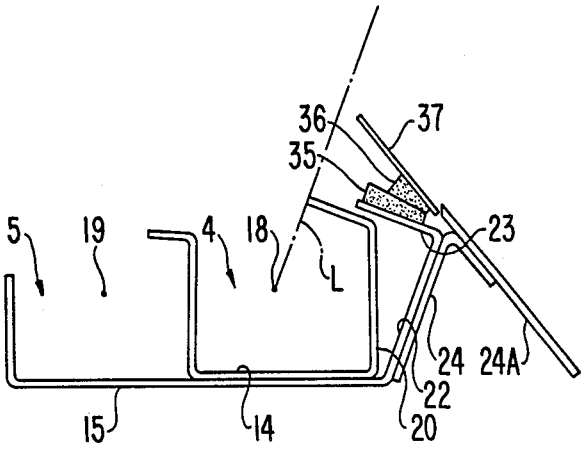

Furthermore, referring to FIG. 9, two sponge members 35, 36 are disposed on an upper surface of a turning member 23 in an overlapped manner and, in order to secure a function as the guide, the sponge member 36 is provided with a rigid plate member 37 disposed thereabove. The sponge member 35 is adapted to be easily bendable in comparison with the sponge member 36.

Figure 10:
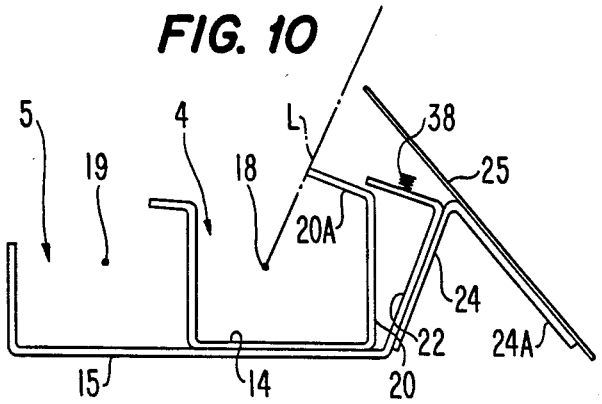
FIGS. 6 to 10 are sectional views showing the lower guide according to the present invention in further preferred embodiments, respectively.

And, furthermore, referring to FIG. 10, he second member 26, formed of a polyester film in FIG. 3, is replaced by a spring 38, the flexible member 25 being disposed with an interval from the spring 38 so that the first member 25 may be engaged with the spring 38 when the first member 25 is bent by 2 predetermined amount quantity. According to this preferred embodiment, the thin paper is guided by the first member 25 alone while the thick paper is guided by both the first member 25 and the spring 38.

And, the lower guide is not always composed of two members. It goes without saying that the lower guide may be composed of three or more members. In such a case, the straight lines of the character diagram characteristics in the FIG. 5 of approach a curve, and as a result, preferable results are obtained.

What is claimed is:

1. A device for guiding paper toward a paper transfer region and a sensitive member, said device comprising:

an upper paper guide to be disposed adjacent the sensitive member;

a lower paper guide to be disposed below the upper paper guide, said lower paper guide comprising at least two elastic members, each said elastic member having a predetermined modulus of elasticity such that said lower paper guide adapts its overall elasticity according to the rigidity of a paper transferred toward said transfer member, and at least portions of said elastic members contacting the paper when the paper is transferred having the properties of an electrical insulator.

2. The device for guiding paper as set forth in claim 1, wherein:

each said elastic member comprises a guide plate and a compression spring biasing said guide plate.

3. The device for guiding paper as set forth in claim 1, wherein:

a first said elastic member comprises a flexible, resilient member and a second said elastic member comprises a resilient sponge for engagement with said flexible resilient member.

4. The device for guiding paper as set forth in claim 1, wherein:

a first said elastic member comprises a guide plate and a compression spring biasing said guide plate and a second said elastic member comprises a resilient sponge supporting said compression spring.

5. The device for guiding paper as set forth in claim 1, wherein:

a first said elastic member comprises a guide plate and a first resilient sponge biasing said guide plate and a second said elastic member comprises a second resilient sponge supporting said first resilient sponge.

6. The device for guiding paper as set forth in claim 1, wherein:

a first said elastic member comprises a flexible resilient member and a second said elastic member comprises a compression spring for engagement with said flexible resilient member.

7. The device for guiding paper as set forth in claim 1, and further comprising:

a transfer charger to be disposed adjacent the sensitive member, said transfer charger comprising a shield casing having an upstream side plate member adjacent said lower paper guide, said upstream side plate having an upper end portion thereof bent so as to extend in a downstream direction and act as a transfer electrifying region controller.

8. The device for guiding paper as set forth in claim 1, wherein:

said lower paper guide further comprises a lower guide plate supporting said at least two elastic members.

9. A guide device for guiding a paper in conjunction with an upper paper guide member toward a sensitive member in an electrophotographic copying machine, said guide device comprising:

a lower paper guide member to be disposed below the upper paper guide member such that the upper and lower paper guide members receive a paper to be transferred toward the sensitive member therebetween; and resilient means disposed on said lower paper guide member for biasing a paper transferred between the upper and lower guide members in a substantially upward direction, said resilient means having a variable spring constant variable with the rigidity of the paper being transferred, said resilient means comprising at least two elastic members.

* * * * *

UNITED STATES PATENT AND TRADEMARK OFFICE

CERTIFICATE OF CORRECTION

PATENT NO. : 4,882,606

DATED : November 21, 1989

INVENTOR(S) : Hiroyuki DEGUCHI

It is certified that error appears in the above-identified patent and that said Letters Patent is hereby corrected as shown below:

Claim 1, line 11, change "transfer" to -- sensitive --.

Signed and Sealed this

Twelfth Day of March, 1991

*Attest:*

HARRY F. MANBECK, JR.

*Attesting Officer*

*Commissioner of Patents and Trademarks*